United States Patent [19]

Ford

[11] 4,089,574

[45] May 16, 1978

[54] PACKAGING OF ELECTRICAL OR ELECTRONIC COMPONENTS

[76] Inventor: Neville George Ford, 64 Darbyshire Road, Mt. Waverley, Victoria, Australia, 3149

[21] Appl. No.: 729,953

[22] Filed: Oct. 6, 1976

[30] Foreign Application Priority Data

Oct. 8, 1975 Australia ..... 3486/75

[51] Int. Cl.[2] ..... B65D 7/28; A47B 87/00

[52] U.S. Cl. ..... 312/108; 312/111; 312/282

[58] Field of Search ..... 312/108, 111, 281, 282; 108/27

[56] References Cited

U.S. PATENT DOCUMENTS

| | | | |
|---|---|---|---|
| 1,802,151 | 4/1931 | Lennon et al. | 312/282 |
| 2,246,966 | 6/1941 | Balkind | 312/108 |
| 2,268,236 | 12/1941 | Baird | 312/111 |
| 2,451,012 | 10/1948 | Balkind | 312/108 |
| 2,550,108 | 4/1951 | Davis | 312/282 |
| 3,031,125 | 4/1962 | Felton | 312/108 |
| 3,145,850 | 8/1964 | Ciborowski | 108/27 |
| 3,275,392 | 9/1966 | Fiterman | 312/108 |
| 3,645,596 | 2/1972 | Russel-French | 312/108 |
| 3,885,845 | 5/1975 | Krieks | 312/108 |

*Primary Examiner*—Paul R. Gilliam
*Assistant Examiner*—Victor N. Sakran
*Attorney, Agent, or Firm*—Andrus, Sceales, Starke & Sawall

[57] ABSTRACT

A device for stiffening a rack for electrical or electronic components having an unsupported sheet includes a stiffener member hingedly attached to an edge of the unsupported sheet. The stiffener may be formed as a box section or as a solid member.

8 Claims, 10 Drawing Figures

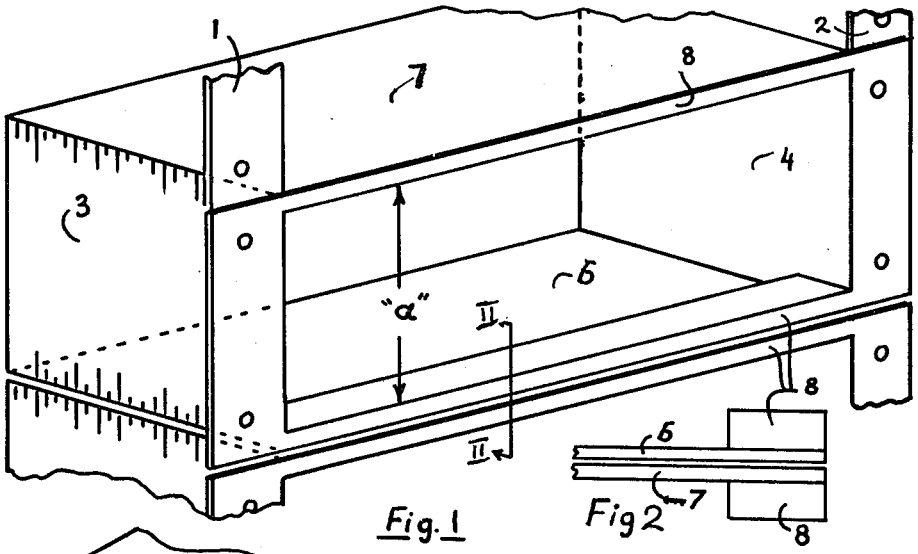
Fig. 1
Fig 2
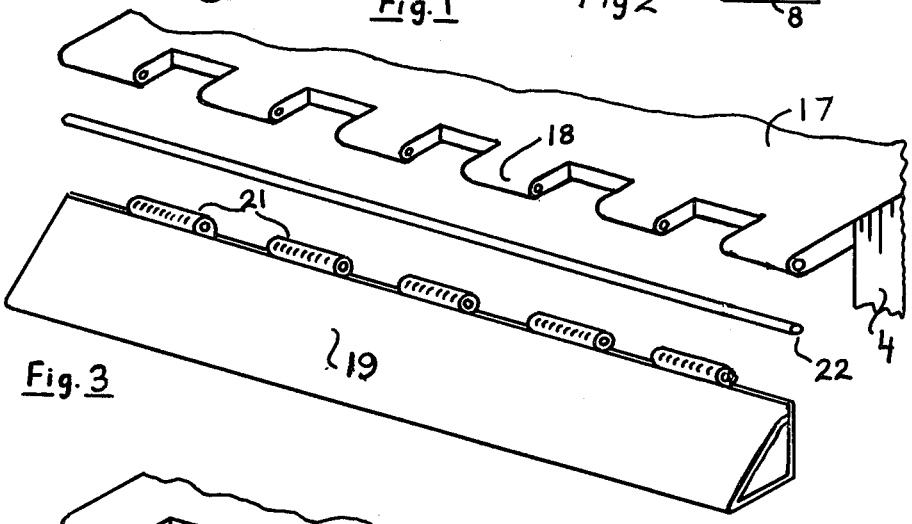
Fig. 3
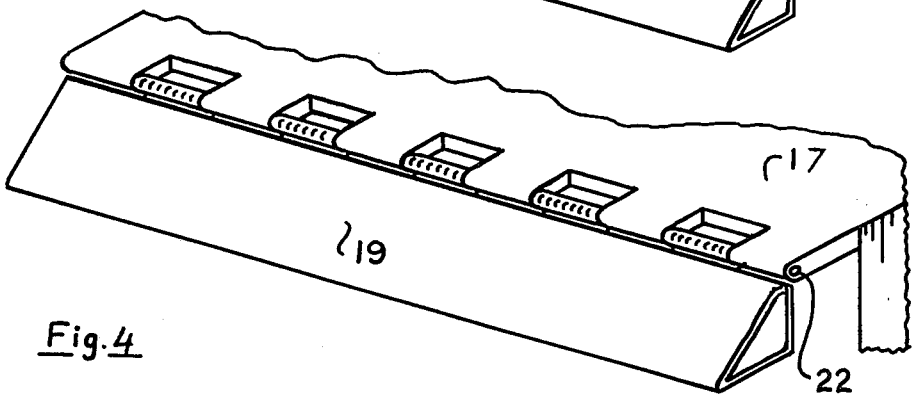
Fig. 4

PACKAGING OF ELECTRICAL OR ELECTRONIC COMPONENTS

BACKGROUND OF THE INVENTION

Field of the Invention

This invention relates to packaging of electrical or electronic components.

It is desirable to package electrical or electronic components within containers and/or on racks of certain standard sizes and that electrical or electronic components and hardware therefor should be of certain standard sizes to be receivable within containers and/or on racks.

With this in mind a number of companies have devised modular units and, recently, certain sizes have been agreed upon as being desirable standards.

In particular, reference is made to an I.E.C. document which is referred to as I.E.C. TC - 13-217. The standards suggested therein are now coming to be accepted.

One undesirable consequence of the standards specified by I.E.C. is that in certain situations it is necessary to use sheets of metal of thickness of about 1.4 mm and width of about 450 mm which are supported at their sides but not across their width. Such sheets are too thin to support their own weight and often sag. Whilst thickening the unsupported edge or securing it to a cross-member would give the desired strength and stiffness, so doing would probably result in the container, racking or other electronic component support means of which the sheet formed part ceasing to comply with these I.E.C. standards.

Since these solutions to the problem are unacceptable, this invention has an object the stiffening of such sheets without causing non-compliance with I.E.C. standards.

SUMMARY OF THE INVENTION

The present invention provides, in a packaging for electrical or electronic components, for instance a racking system, a module, a housing, a component mounting, a mounting frame or a housing, a sheet unsupported along an edge and, in its own right, tending to bow along said edge under its own weight or under component loads and wherein said edge is stiffened by a stiffener member hingedly attached to said edge and wherein said stiffener can be hingedly swung between first and second positions in which it respectively does not project beyond the plane of one surface and the opposite surface of said sheet.

PREFERRED ASPECTS

It is particularly preferred that the stiffener member is such as to stiffen said edge in all hinged orientations thereof. To this end the stiffener member may be made of a material having substantially greater stiffness than said sheet at said edge. However, it is particularly preferred that the stiffener member is of substantially greater cross-sectional thickness relative to said sheet at said edge and measured in a plane perpendicular to the sheet at said edge in all of said hinged orientations. In this last aspect it is preferred that the cross-sectional thickness as aforesaid of the stiffener member is at least 3 times, more preferably 5 times, that of the sheet at said edge.

As it is likely that in some circumstances two such sheets will be placed parallel and in contiguity it is preferred that the stiffener members of the two sheets are so shaped that in such circumstances both stiffener members may be hingedly swung between first and second positions so as, respectively, not to project beyond the plane of the surface of one sheet most remote from the other sheet and the plane of the surface of said other sheet most remote from said one sheet. Further, it is preferred that the stiffener members of the two sheets are so shaped as not to project towards the respective sheets beyond a plane, which plane being perpendicular to the aforesaid planes and passing through said edge of each of the two sheets, when in the first and second positions. However, given that the dimensions of the stiffener members are not such as to take up a significant area of the sheets such projection may be permissible in certain instances.

In another instance where there are two such sheets in parallel and contiguity it may only be necessary to use one stiffener member. In this respect, if it is desired to stiffen both sheets it may be necessary that they be secured to one another.

The preferred form of the stiffener member is a longitudinally extending angle, solid member or box section. The use of a box section rather than a solid section will give greater stiffness per unit of weight but manufacturing sensibilities may dictate the use of solid sections.

It is preferred that the cross-sectional shape of the solid member or box section is that of a right angle triangle having 45° as the other angles or an equilateral triangle. A quadrant is also a desired cross-sectional shape. When the solid member or box member has the cross-sectional shape of a right angle triangle having 45° as the other angles it is preferred that the hinged attachment thereof to the sheet is at one of the 45° angles rather than at the right angle and where two sheets with two stiffener members are in parallel and contiguity it is particularly desirable that the hypotenueses of those triangles are adjacent to one another.

Although in many instances it would be undesirable that the stiffener member or members should project as aforesaid, such projection can be of use to support another such sheet which is not provided with a stiffener member.

The sheet may be made of metal or synthetic plastics material; the former being more probable.

The present invention has particular application to sheets of thickness 0.5 to 3 mm, preferably about 1.4 mm, width measured along said edge of 200 to 1000 mm, preferably about 450 mm and of indeterminate length.

The stiffener member preferably has a maximum cross-sectional thickness, measured radially of the axis of hinging, of at least 5 mm, more preferably at least 10 mm and preferably not more than 100 mm, more preferably not more than 50 mm and still more preferably not more than 20 mm and most preferably about 10.0 mm.

The hinged attachment of the stiffener member to the sheet is unlikely, except in rare circumstances, to be achievable by securing a strap of a hinge to said sheet as so doing, in the context of electronics packaging, is likely to unacceptably increase the thickness of the sheet.

However, in one instance the hinged attachment is provided by a thin flexible material extending between the sheet and the stiffener member. In a particular instance of this the sheet, thin flexible material and stiffener are integrally formed such as by extrusion or by pressing an extruded member to form the thin flexible material.

When the sheet is to be of metal it is preferred that said edge is formed to constitute one part of the knuckle of the hinge, the other part of the knuckle being attached to or formed with a stiffener member and there is a hinge pin joining the two knuckle parts. This last is currently the most preferred construction.

The present invention also provides such a sheet having such a stiffener member hingedly attached thereto.

Specific constructions in accordance with this invention will now be described with the aid of the accompanying drawings.

BRIEF DESCRIPTION OF THE VIEWS OF THE DRAWINGS

FIG. 1 is a perspective view of a known racking system,

FIG. 2 is a fragmentary cross-sectional view on line II—II in FIG. 1,

FIG. 3 is a perspective view of a sheet and a stiffener member in accordance with this invention but in disassembled condition, FIG. 4 is a perspective view of the sheet and a stiffener member of FIG. 3 but in assembled condition.

DETAILED DESCRIPTION

Figure 5:
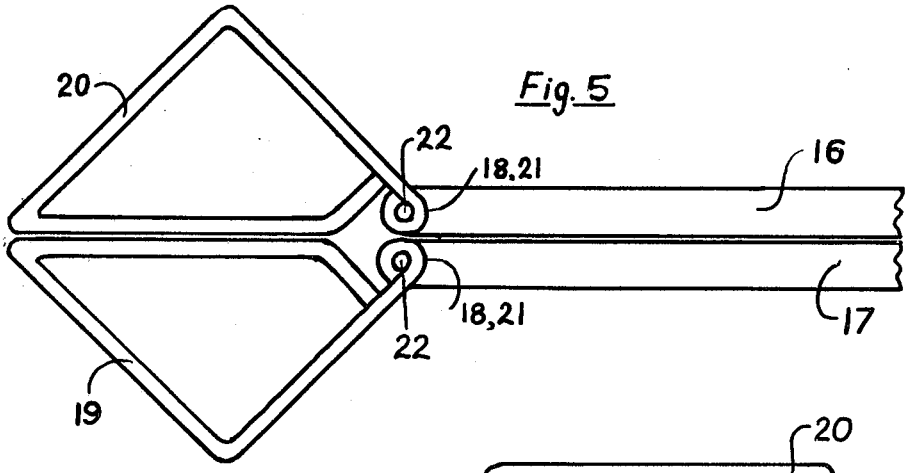
FIG. 5 is a side elevation showing two sheets and a stiffener member in accordance with this invention of FIG. 4 in alternative configurations.
Figure 6:
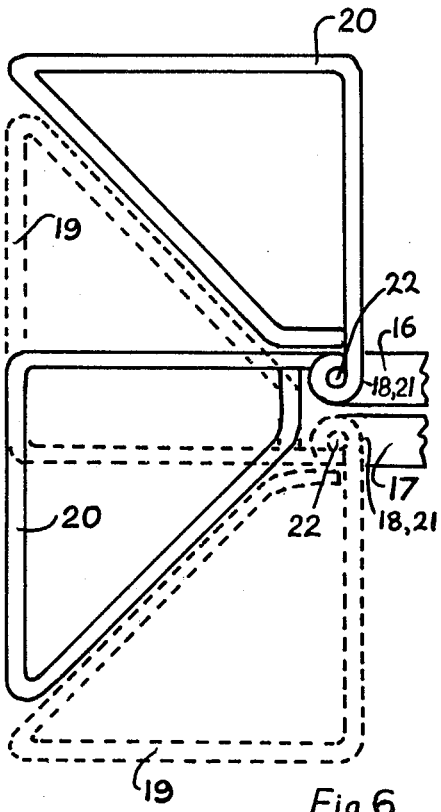
FIG. 6 is a side elevation of the sheets and a stiffener member shown in FIG. 5 but in alternative configurations.
Figure 7:
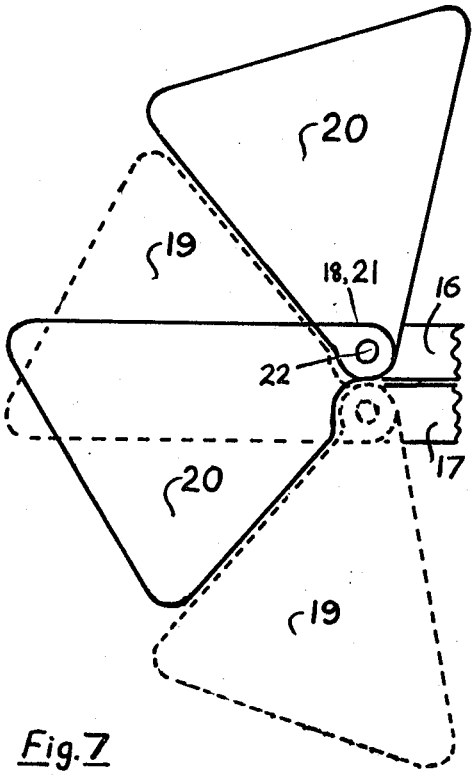
FIG. 7 is a side elevation showing two alternative stiffener members in accordance with this invention.

In FIG. 1 is shown a known racking system comprising vertical side stiles 1 and 2 which support containers comprised of sides 3 and 4 and top and bottom sheets 7 and 6 of about 1.4 mm thickness, 450 mm width and indeterminate depth. Facing members 8 are also provided but, if sufficiently thick and attached to the sheets 6 and 7 to provide adequate reinforcement, may make the aperture "*a*" unacceptably small.

Since the sheets 6 and 7 will tend to sag under their own weight and under loading, there is a problem which can at least in part be overcome as shown in FIGS. 3 – 6 where sheets 16 and 17 have hinge knuckle parts 18 and stiffener members 19 and 20 have hinge knuckle parts 21 and which hinge knuckle parts are connected by a hinge pin 22.

The stiffener members 19 and 20 are box sections and will stiffen the sheets 16 and 17. Further, the stiffener member can be oriented as shown in full or dash lines in FIG. 6 where they respectively do not extend above and below sheets 16 and 17 and thus in no way affect the location of electronic components or enter the containers. When access to the containers is not required the location in intermediate positions as shown in FIG. 5 is permissible.

The constructions shown in FIGS. 7 – 10 differ from that of FIGS. 3 – 6 in that differently shaped stiffener members are used and that the stiffener members are solid.

Figure 8:
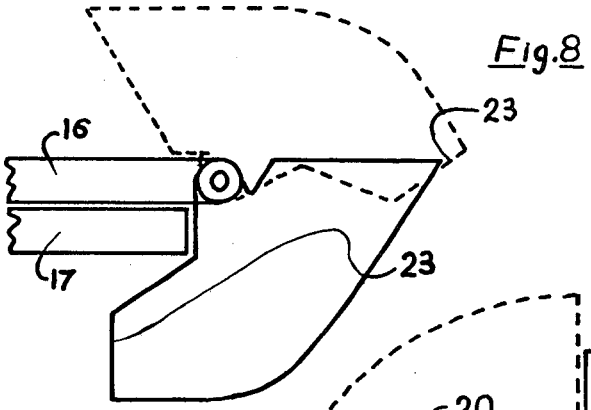
FIG. 8 is a side elevation showing an alternative stiffener member in accordance with this invention.
Figure 9:
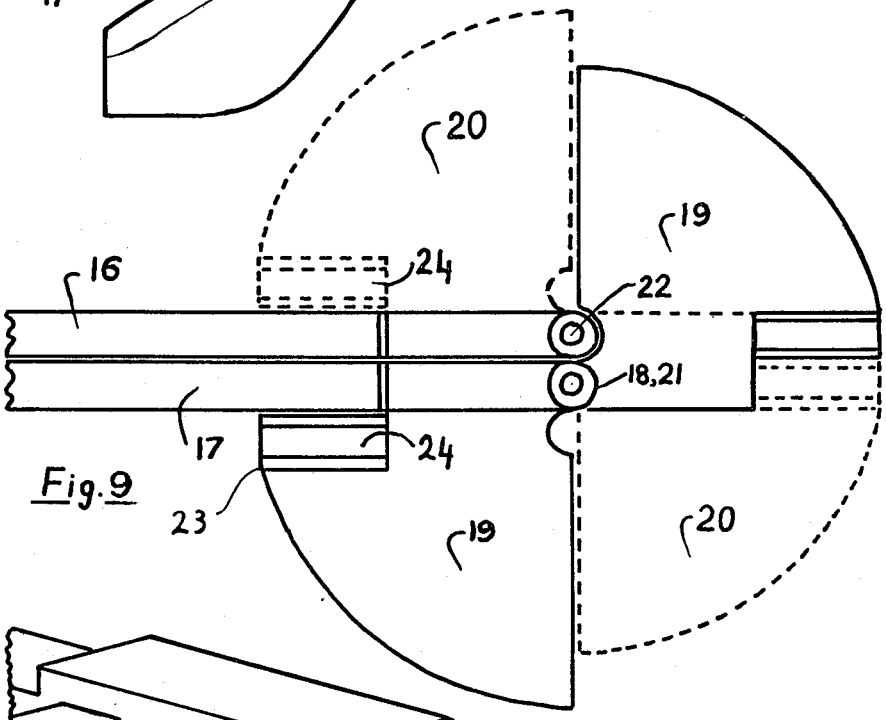
FIG. 9 is a side elevation showing an alternative stiffener member in accordance with this invention.

In the constructions shown in FIGS. 8 and 9 the stiffener members are shaped so that when the upper one or part thereof is oriented to lie in the same plane as the upper surface of the sheet 16 the other or another part thereof will enter the container. Given that the amount of entrance does not exceed about 15 mm this is not deleterious and permits the stiffener to also locate components or restrict movement of components by means of the end 23 as shown in FIG. 8 and FIG. 9.

It is to be noted in respect of FIG. 8 that only the top sheet 16 is provided with a stiffener and that the bottom sheet 17 is unstiffened. This will be satisfactory in gravity load only situations but, if desired, the sheets 16 and 17 can be secured to one another so that sheet 17 derives its stiffness from sheet 16.

Figure 10:
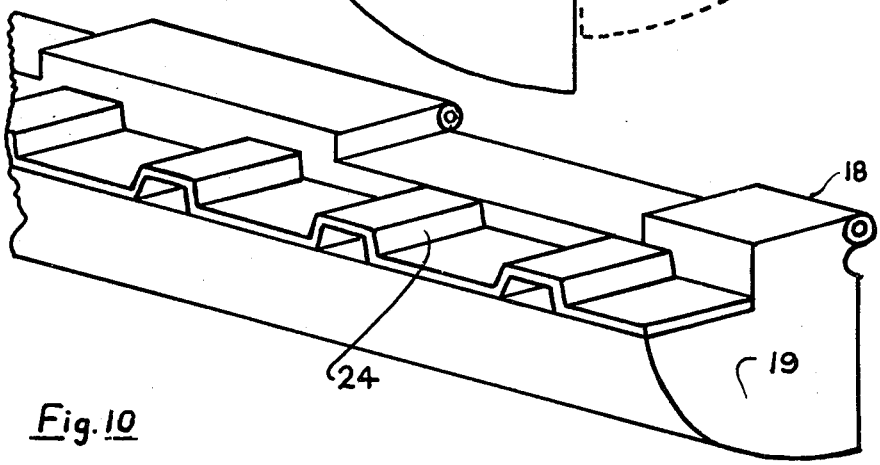
FIG. 10 is a perspective detail of a part shown in FIG. 9.

Referring now to FIGS. 9 and 10, the stiffeners 19 and 20 are provided with a plate 24 having lands. These lands can serve to locate components and restrict them against sideways movement if those components have projections which can be received between the lands. In an alternative to the plate 24 the stiffeners 19 and 20 may be provided with upstanding projections such as pins received within holes in the stiffeners 19 and 20.

Modifications and adaptations may be made to the above described without departing from the spirit and scope of this invention which includes every novel feature and combination of feature disclosed herein.

The claims form part of the disclosure of this specification.

The standards prescribed in I.E.C. TC - 13 - 217 have recently been republished by the International Electrotechnical Commission (I.E.C.) as Publication Nos. 297 and 473.

I claim:

1. In a housing for packaging electrical or electronic components having a generally horizontal planar sheet of predetermined thickness unsupported along an edge and tending to bow along said edge under the weight of the sheet or component loads: a means for stiffening said edge comprising a stiffening member hingedly attached along the entirety of said edge for being swung between first and second positions in which it, respectively, does not project beyond the plane of one surface and the opposite surface of said sheet; said member having portions thereof displaced from said hinge along the edge radially of the axis of hinging; said member being formed of a structural material and having a cross-sectional configuration in a plane normal to said edge and the axis of hinging enabling the stiffness member to stiffen said edge in all hinged orientations of said stiffener member.

2. A stiffener member as defined in claim 1 wherein the cross-sectional configuration of said stiffener member is such as to position a sufficient amount of material out of the plane of the sheet and sufficiently radially distant from the axis of hinging to prevent bowing of the sheet in all hinged orientations of said stiffening member.

3. A stiffening member as defined in claim 1 wherein the cross-sectional configuration of said stiffener member is such that the member has a dimension in a direction extending out of the plane of the sheet substantially greater than the thickness of said sheet in all hinged orientations of said stiffener member.

4. A stiffener member as defined in claim 3 wherein the cross-sectional configuration of said stiffener member is such that the member has a dimension in a direction extending out of the plane of the sheet at least three times the thickness of the sheet in all hinged orientations of said stiffener member.

5. A stiffener member as defined in claim 1 wherein said stiffener member is hollow.

6. A stiffener member as defined in claim 5 wherein said hollow member is formed of bent sheet material.

7. A stiffener member as defined in claim 3 wherein the sheet has a thickness of from 0.5 to 3 mm and wherein the stiffener member has a dimension of at least 5 mm in a direction extending out of the plane of the sheet in all hinged orientations of said stiffener member.

8. A stiffener member as defined in claim 1 wherein the stiffener member is solid.

* * * * *